US009650163B2

(12) United States Patent
Odman et al.

(10) Patent No.: US 9,650,163 B2
(45) Date of Patent: May 16, 2017

(54) BAG LOADING APPARATUS

(75) Inventors: Todd D. Odman, Selah, WA (US); Alberto Soto, Yakima, WA (US)

(73) Assignee: Packing House Services, Inc., Yakima, WA (US)

( * ) Notice: Subject to any disclaimer, the term of this patent is extended or adjusted under 35 U.S.C. 154(b) by 678 days.

(21) Appl. No.: 13/094,823

(22) Filed: Apr. 27, 2011

(65) Prior Publication Data

US 2011/0271645 A1 Nov. 10, 2011

Related U.S. Application Data

(60) Provisional application No. 61/329,060, filed on Apr. 28, 2010.

(51) Int. Cl.

| | |
|---|---|
| ***B65B 5/08*** | (2006.01) |
| ***B65B 43/26*** | (2006.01) |
| ***B65B 43/44*** | (2006.01) |
| ***B65B 5/10*** | (2006.01) |
| *B65B 5/06* | (2006.01) |
| *B65B 5/04* | (2006.01) |

(52) U.S. Cl.

CPC ..... *B65B 5/08* (2013.01); *B65B 5/10* (2013.01); *B65B 43/26* (2013.01); *B65B 43/44* (2013.01); *B65B 5/045* (2013.01); *B65B 5/067* (2013.01)

(58) Field of Classification Search

USPC ..... 53/469, 384.1; 211/54.1, 85.15, 71.01
IPC ..... B65B 5/045,5/00, 5/067, 43/12, 43/14, 43/42, 43/44, 67/1266, 67/12
See application file for complete search history.

(56) References Cited

U.S. PATENT DOCUMENTS

| | | | | |
|---|---|---|---|---|
| 3,468,100 | A * | 9/1969 | Rubel | 53/572 |
| 3,472,388 | A * | 10/1969 | Blase | 211/57.1 |
| 3,555,977 | A * | 1/1971 | Saumsiegle | B31B 19/98 198/610 |
| 3,556,316 | A * | 1/1971 | Marasso et al. | 414/795.8 |
| 3,685,252 | A * | 8/1972 | Wouda | B65B 67/04 53/385.1 |
| 3,896,510 | A * | 7/1975 | O'Connell | E03D 11/16 285/56 |
| 4,252,233 | A * | 2/1981 | Joice | 198/692 |
| 4,434,895 | A * | 3/1984 | Voso et al. | 206/554 |
| 4,644,735 | A * | 2/1987 | Savigny | 53/570 |
| 4,832,290 | A * | 5/1989 | Baglio | B65D 71/50 248/311.2 |
| 4,842,436 | A * | 6/1989 | Stinson | 402/80 R |
| D395,566 | S * | 6/1998 | Helseth | B65B 5/105 D6/515 |
| 5,802,817 | A * | 9/1998 | Hood | 53/459 |
| 5,933,996 | A * | 8/1999 | Chang | 40/748 |
| 6,193,200 | B1 * | 2/2001 | Kao | 248/309.1 |
| 6,311,740 | B1 * | 11/2001 | Sperry et al. | 141/129 |

(Continued)

*Primary Examiner* — Christopher Harmon
(74) *Attorney, Agent, or Firm* — Michelle Bos Legal LLC

(57) ABSTRACT

A bag loading apparatus for removably supporting a cartridge of wicketed bags. The bag loading apparatus comprises a front slider plate having a wicket slot therein. The wicket slot is adapted to receive and removably retain the wicket arms of a cartridge of wicketed bags. In an embodiment, a second slider plate is spaced apart from the front slider plate. In an additional embodiment, a wicket retaining arm retains the cartridge of wicketed in bags in place. In a further embodiment, a bag retaining means holds each bag in an open position as it is being filled.

12 Claims, 5 Drawing Sheets

(56) References Cited

U.S. PATENT DOCUMENTS

| | | | | |
|---|---|---|---|---|
| 6,648,153 | B2 * | 11/2003 | Holmes | G06Q 10/087 211/12 |
| 6,789,771 | B1 * | 9/2004 | Shick et al. | 248/121 |
| 7,080,756 | B2 * | 7/2006 | Cunningham | A47F 9/042 206/554 |
| 7,887,146 | B1 * | 2/2011 | Louie | A61J 1/16 211/85.15 |
| 8,534,462 | B1 * | 9/2013 | Tan | 206/554 |
| 2004/0148912 | A1 * | 8/2004 | Lambrecht | B65B 5/105 53/473 |
| 2007/0090066 | A1 * | 4/2007 | Weldon et al. | 211/59.1 |
| 2008/0197245 | A1 * | 8/2008 | Weldon | B65B 43/14 248/95 |
| 2011/0017894 | A1 * | 1/2011 | Yu | H05K 7/1489 248/309.1 |

* cited by examiner

BAG LOADING APPARATUS

BACKGROUND OF THE INVENTION

The invention relates to an improved bag loading apparatus. More particularly, the invention relates to a device for facilitating the quick loading and reloading of a cartridge of wicketed bags on a bag filling apparatus, such as is used in association with a sorting and packing line. Various articles are packaged using an automated system whereby the articles are conveyed along a moving belt to a point at which a quantity of articles is deposited into a bag held open to receive the articles. Once filled, the bag is removed and a new bag is readied to receive the next quantity of articles. When the supply of bags is exhausted, a new supply is loaded.

Examples of existing bag loading devices for use with wicketed bags are found in U.S. Pat. No. 3,556,316 (Marasso et al.), U.S. Pat. No. 3,807,122 (Kihnke et al.), U.S. Pat. No. 4,192,122 (Florindez), U.S. Pat. No. 4,253,292 (Lipes), U.S. Pat. No. 5,174,094 (Powell, Jr.), U.S. Pat. No. 5,442,898 (Gabree et al.), U.S. Pat. No. 5,473,865 (Tanaka et al.), and U.S. Pat. No. 7,024,840. Each of these devices addresses the challenge of loading a supply of bags to be available for a bag loading apparatus, while avoiding to the extent possible the need to shut down the packing system conveyor. Despite these various attempts to provide a device that allows for the loading of wicketed bags on a bag loading apparatus, a need remains for a simple device that removably supports a supply of wicketed bags, and allows for the rapid refilling of the wicketed bag supply without slowing down or stopping the packing system conveyor.

BRIEF SUMMARY OF THE INVENTION

The invention comprises a bag loading apparatus for removably supporting a cartridge of wicketed bags. The bag loading apparatus comprises a front slider plate having a wicket slot therein. The wicket slot is adapted to receive and removably retain the wicket arms of a cartridge of wicketed bags. In an embodiment, a second slider plate is provided spaced apart from the front slider plate. In an additional embodiment, a wicket retaining arm retains the cartridge of wicketed in bags in place. In a further embodiment, a bag retaining means holds each bag in an open position as it is being filled.

DETAILED DESCRIPTION OF THE INVENTION

Figure 1:
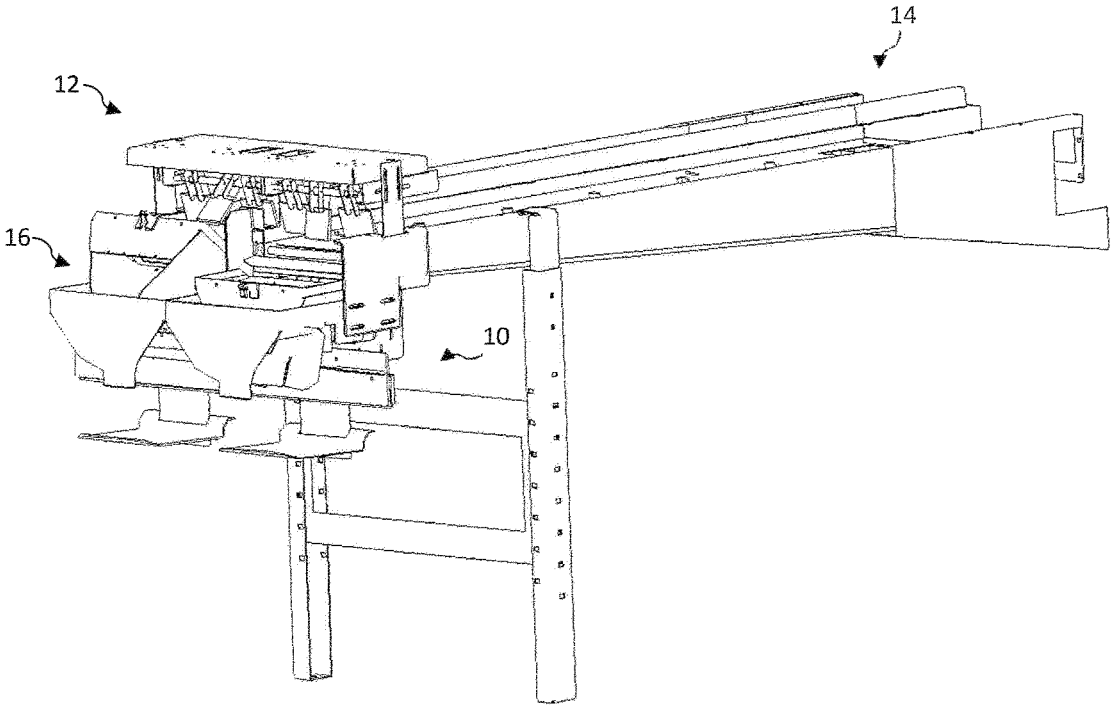
FIG. 1 is a perspective view of an improved bag loading apparatus, mounted on a packing system conveyor.

The improved bag loading apparatus of the present invention is generally identified in the accompanying drawings by numeral 10. The bag loading apparatus can be used with a packing system 12 having a conveyor 14 and a bag filling spout 16, as shown in FIG. 1. The bag loading apparatus is adapted to receive a cartridge 18 of wicketed bags comprising a wicket 20 having a pair of wicket arms, shown in FIG. 5 as first arm 22 and second arm 24, and at least one bag 26. In FIG. 1, the bag loading apparatus 10 is shown positioned below the bag filling spout 16 of the packing system 12.

Figure 2:
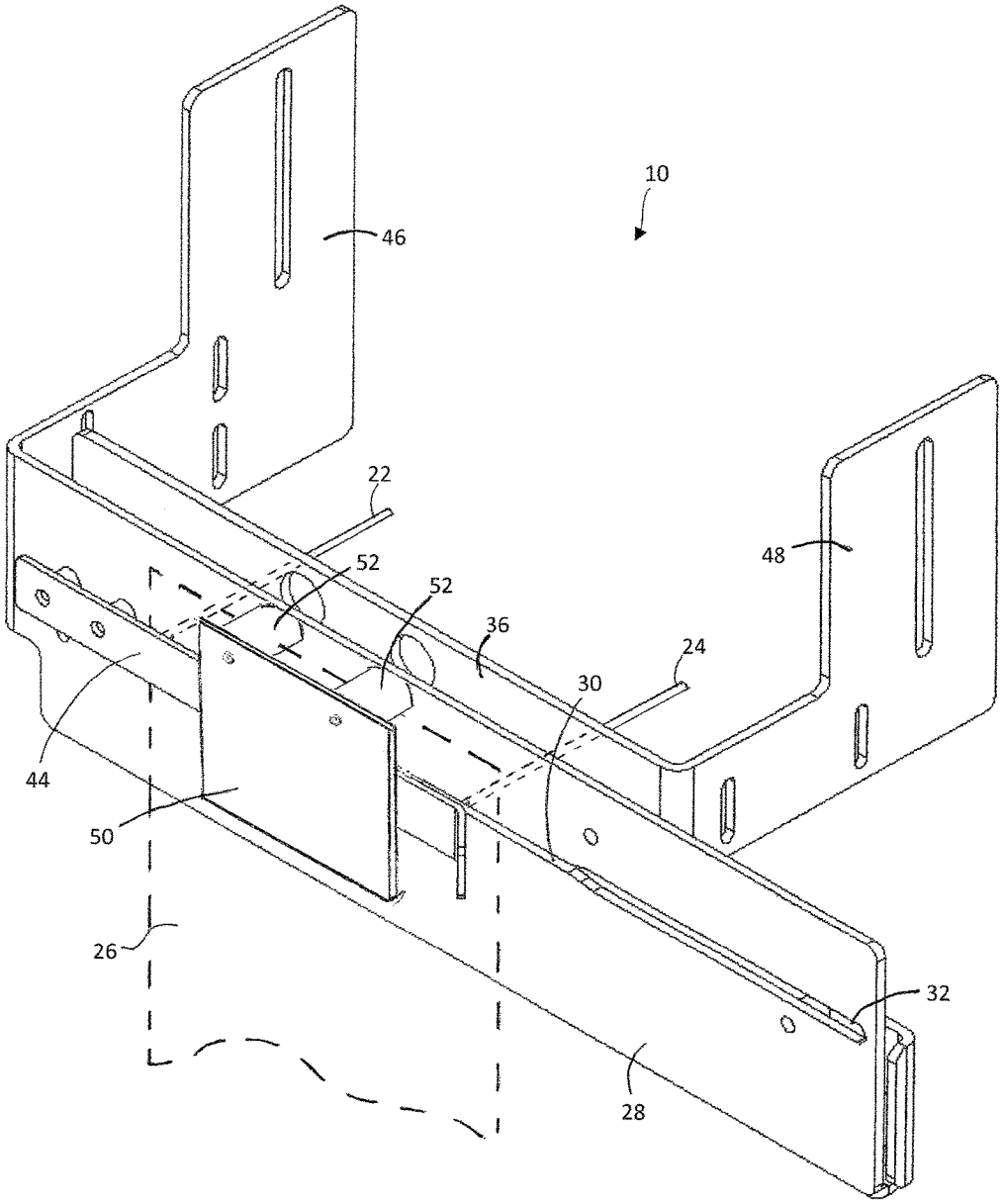
FIG. 2 is a perspective view of an improved bag loading apparatus, with a wicketed bag shown in dotted outline.
Figure 3:
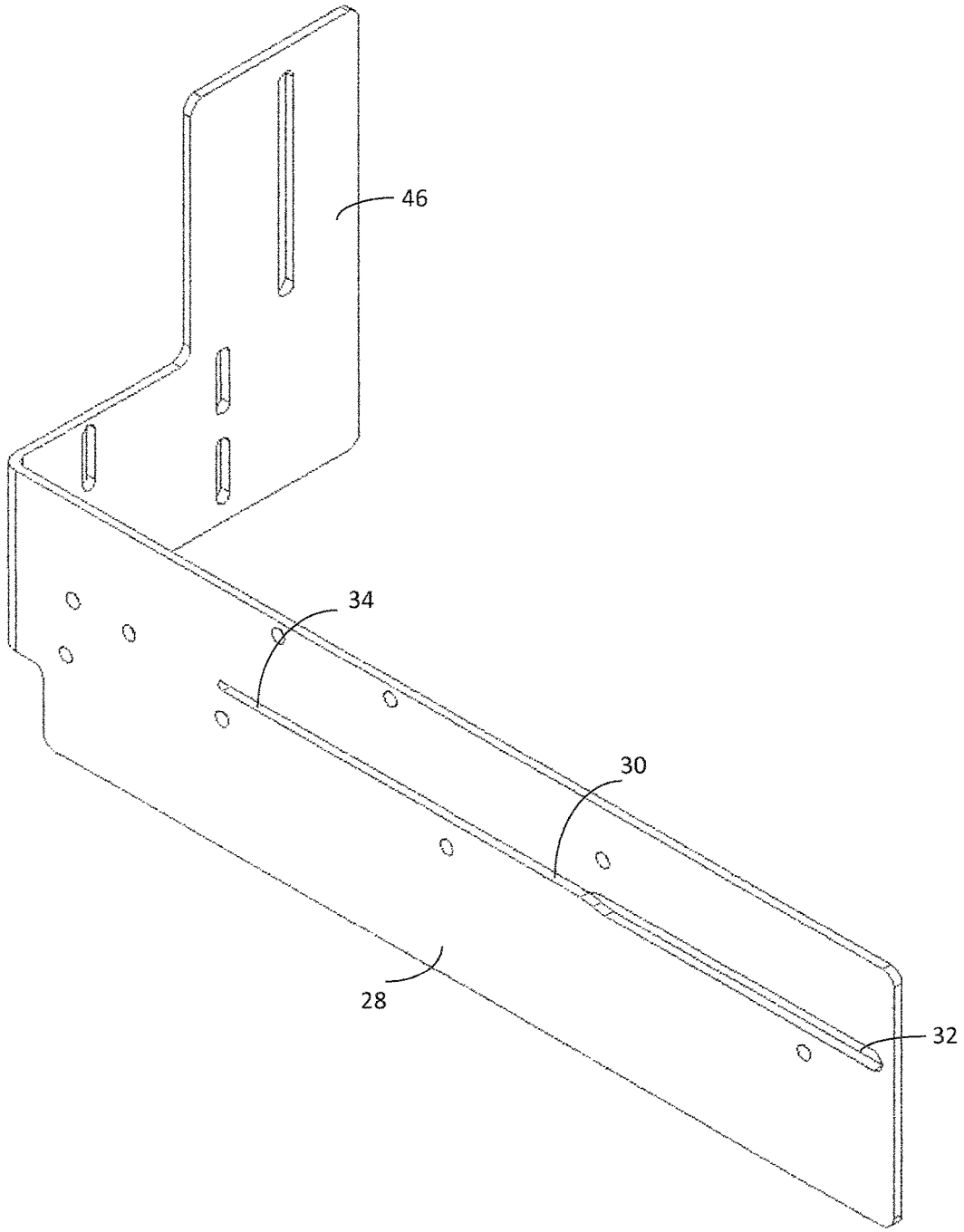
FIG. 3 is a perspective view of the front slider plate of the improved bag loading apparatus.

The bag loading apparatus 10 comprises a front slider plate 28 having an elongated wicket slot 30 therein, as shown in FIGS. 2 and 3. The wicket slot has a wicket receiving portion 32 and a wicket retaining portion 34, and is sized to receive the wicket first arm 22 and the wicket second arm 24. In a preferred embodiment, the wicket receiving portion of the wicket slot is slightly wider than the thickness of the wicket arms, so as to loosely receive the wicket arms. The wicket retaining portion of the wicket slot is more closely sized to the thickness of the wicket arms, so as to more snugly receive and retain the wicket arms. The wider wicket receiving portion facilitates rapid insertion of the wicket arms in the wicket slot, while the narrower wicket retaining portion limits the movement of the wicket arms in the slot. The benefit of this arrangement will be made apparent below.

In the embodiment shown in the drawings, the wicket slot 30 is closed at both ends. In an alternative embodiment (not shown), the wicket slot is open at the end of the wicket receiving portion 32.

Figure 4:
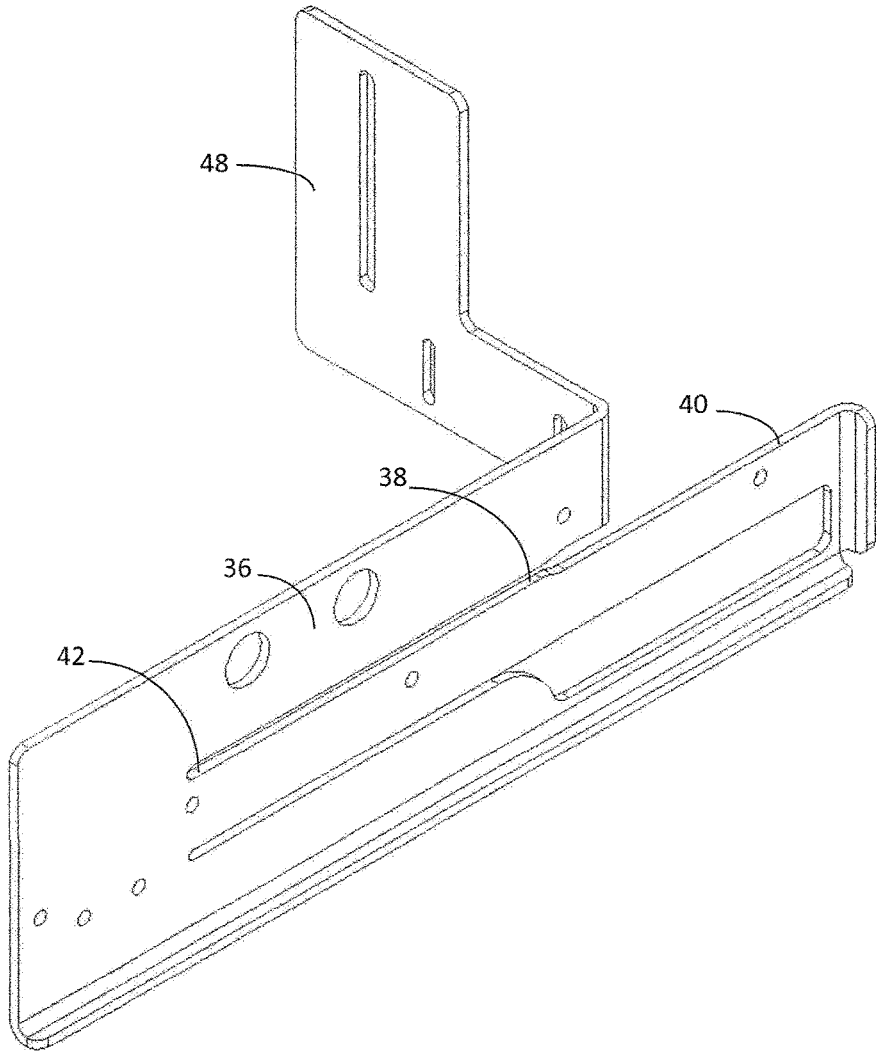
FIG. 4 is a perspective view of the second slider plate of the improved bag loading apparatus.

In a preferred embodiment of the invention, a second slider plate 36 is provided, as shown in FIGS. 2 and 4. In this preferred embodiment, the front slider plate 28 and second slider plate are spaced apart, substantially parallel planes. The second slider plate includes a second wicket slot 38. The second wicket slot 38 has a second wicket receiving portion 40 and a second wicket retaining portion 42. The wicket slot 30 on slider plate 28 and the second wicket slot 38 on second slider plate 36 are substantially aligned such that wicket arms 22 and 24 inserted into the wicket receiving portion 32 of the wicket slot 30 will pass through the second wicket receiving portion 40 of the second wicket slot 38 in the second slider plate 36. Alternatively, the second wicket slot 38 may include only a second wicket retaining portion, such that wicket arms 22 and 24 inserted into the wicket receiving portion 32 of the wicket slot 30 do not pass through the second wicket slot 38 in the second slider plate 36. In either embodiment, the wicket arms 22 and 24 can be fully inserted into the wicket receiving portion 32 of the wicket slot, then slid in the direction of the wicket retaining portion 34 of the wicket slot. The second slider plate 36 and the second wicket retaining portion 42 of the second wicket slot 38 maintain the wicket arms 22 and 24 in a substantially horizontal position, thus supporting the supply of bags 26 suspended therefrom.

In an alternative embodiment of the invention (not shown), no second slider plate 36 is provided. Instead, the wicket slot 30 in the slider plate 28 is of sufficient depth to stabilize the wicket arms 22 and 24, or is provided with other stabilizing means for maintaining the orientation of the wicket arms.

In a preferred embodiment, the bag loading apparatus further comprises a wicket retaining arm 44 for retaining the wicket 20 and bags 26 in position in the wicket retaining portion 34 of the wicket slot. Preferably, the wicket receiving arm is in substantially parallel alignment with the wicket slot 30. In the embodiment shown in shown in FIG. 2, the wicket retaining arm is secured to the face of the slider plate near the wicket retaining portion of the wicket slot. Other attachment points and configurations are contemplated and are considered to be within the scope of the invention.

The bag loading apparatus 10 is adapted to be secured in a functional position relative to the packing system 12. The exact manner in which the apparatus is secured will vary depending upon the particular configuration of the packing system. In the embodiment shown in the drawings, a first mounting bracket 46 extends perpendicularly from the front slider plate 28 near the wicket retaining portion 34, and a second mounting bracket 48 extends perpendicularly from second slider plate 36. The mounting brackets are adapted to be bolted or otherwise secured in a desired position relative to the packing system 12. In this embodiment, the mounting brackets and slider plates are formed from a single contiguous sheet of aluminum or other suitable material. Other mounting bracket configurations are contemplated and are considered to be within the scope of the invention.

In an additional embodiment of the invention, a downwardly extending bag retaining means 50 is provided, as shown in FIG. 2. The bag retaining means is secured near its upper edge to the front slider plate 28 above the wicket retaining portion 34 of the wicket slot 30. Spacers 52 are used to position the bag retaining means so that it is spaced away from the front slider plate and the wicket retaining arm 44. Preferably, the bag retaining means is flexibly mounted to the front slider plate. In the embodiment shown in FIG. 2, the spacers are made of flexible rubber.

The bag loading apparatus of the present invention is used in conjunction with a packing system 12. The packing system includes a conveyor 14 for transporting articles to be packaged from a first location—for example, a sorting or weighing location—to a packaging location. When the articles to be packaged reach the packaging location, a bag filling spout 16 directs the articles from the conveyor into a bag. The bag loading apparatus is mounted below the bag filling spout to supply bags to receive the articles to be packaged.

Figure 5:
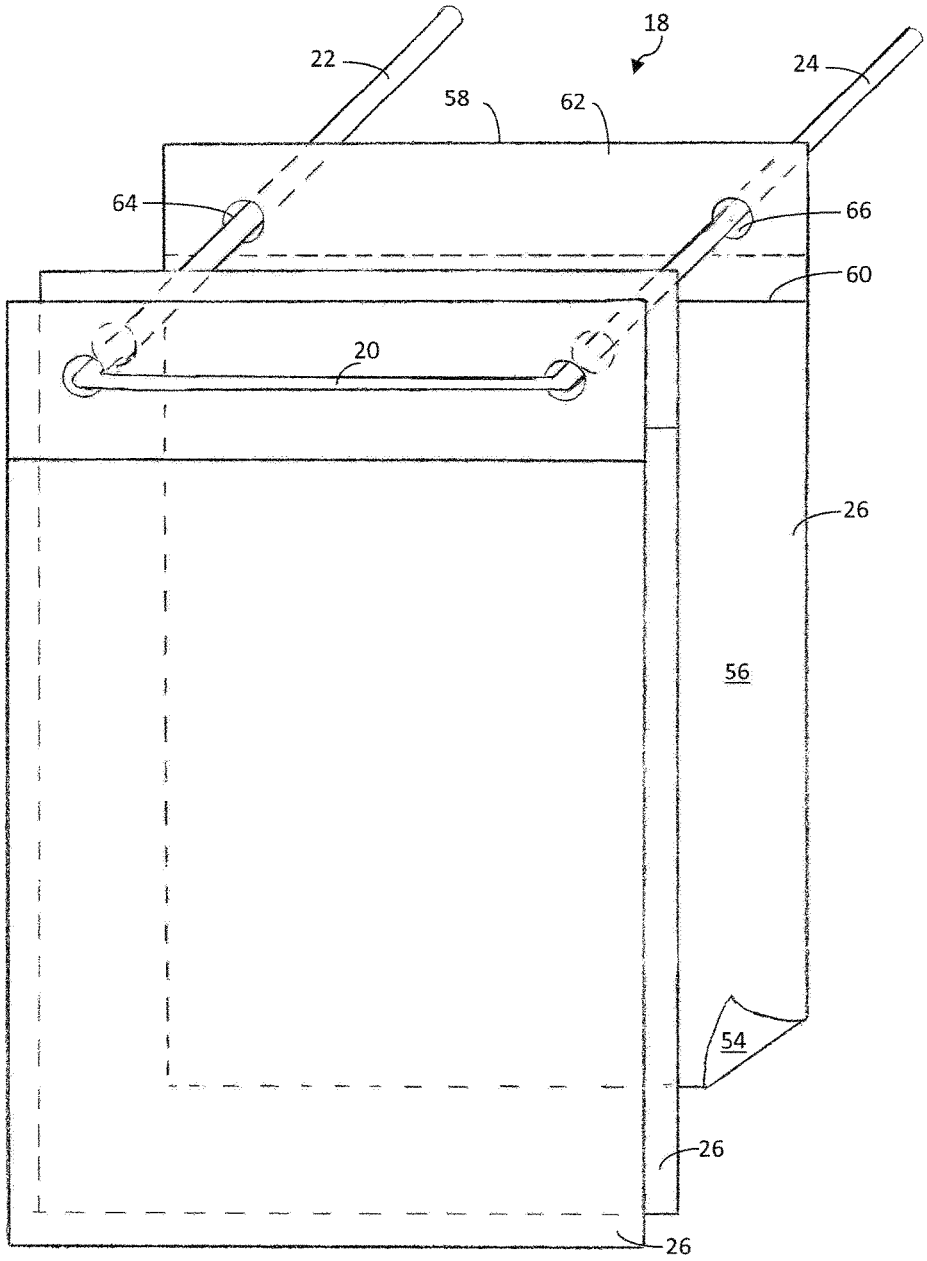
FIG. 5 is a perspective view of a cartridge of wicketed bags as used with the improved bag loading apparatus.

According to the present invention, the bag 26 is a wicketed bag having a bag back 54 and a bag front 56, as shown in FIG. 5. The open upper edge 58 of the bag back extends above the open upper edge 60 of the bag front to form a tab 62. Spaced apart wicket receiving holes 64, 66 are provided in the tab for receiving the wicket arms 22, 24 of wicket 20. A plurality of bags 26 are pre-loaded on the wicket 20 to form a cartridge 18, which can be quickly and efficiently installed and replaced on the bag loading apparatus while the packing system 12 is running. The bag design may vary according to the manufacturer and the goods to be packed.

To use the improved bag loading apparatus, a cartridge 18 of wicketed bags is loaded onto the bag loading apparatus by first fully inserting wicket arms 22, 24 into the wicket receiving portion 32 of the wicket slot 30, so that the wicket 20 and bags 26 are pressed against the front slider plate 28. Next, the cartridge 18 is slid along the wicket slot 30 toward the wicket retaining portion, while continuing to press the wicket 20 and bags 26 against the front slider plate 28. Once the cartridge is in position at the retaining end of the wicket slot, the wicket retaining arm 44 holds the cartridge in place. The bags 26 are suspended from the wicket 20, and are hanging substantially vertically therefrom. Bag back 54 is oriented toward the packing system 12, while bag front 56 is oriented away from the packing system 12 and toward an operator (not shown) positioned near the bag filling spout 16 at the end of the conveyor 14.

During the packaging operation, the operator grasps the upper edge 60 of the bag front 56 and pulls it forward slightly, past the bag retaining means 50, to open the bag 26. The bag retaining means 50 retains the bag back 54 in place. Articles are dispensed from the bag filling spout 16 into the open bag 26. The operator then pulls down on the filled bag 26 to release it from the wicket and remove it from the bag loading apparatus. These actions are repeated until the supply of bags 26 is exhausted and the cartridge 18 is empty.

To replace an empty cartridge 18 with a full cartridge, the empty cartridge (which may include a wicket 20 with or without tabs 62) is slid from the wicket retaining portion 34 of the wicket slot 30 to the wicket receiving portion 32 of the wicket slot 30. The empty cartridge 18 is then pulled away from the slider plate 28 until the wicket arms 22, 24 are clear of the wicket slot 30. A new cartridge 18 is installed as described above. The entire operation of replacing an empty cartridge with a full one can be accomplished in a matter of seconds, thus eliminating the need to slow down or stop the conveyor 14.

The improved bag loading apparatus is described herein as used with a packing system in which the bag filling step is carried out manually, i.e., by a human operator who opens the bag 26, and removes the bag when filled. However, the bag loading apparatus can also be adapted for use with automated weighing and bagging systems (not shown).

In compliance with the statutes, the invention has been described in language more or less specific as to structural features and process steps. While this invention can be embodied in different forms, the specification describes and illustrates preferred embodiments of the invention. It will be understood that this disclosure is an exemplification of the principles of the invention, and is not intended to limit the invention to the particular embodiments described. Those with ordinary skill in the art will appreciate that other embodiments and variations of the invention, which employ the same inventive concepts as the invention, are possible. Therefore, the invention is not to be limited except by the following claims, as appropriately interpreted in accordance with the doctrine of equivalents.

We claim:

1. An apparatus for removably supporting a cartridge of wicketed bags, wherein the cartridge of wicketed bags comprises a wicket having a crossmember, a pair of wicket arms each having a first end affixed to an end of the crossmember and a second distal end, and one or more bags suspended from the wicket arms, the apparatus comprising:

a front slider plate having a front side, a rear side, and an elongated front wicket aperture, wherein the front slider plate is adapted to receive the cartridge of wicketed bags such that the wicket crossmember and bags remain on the front side of the slider plate and the distal ends of the wicket arms pass through the front wicket aperture and extend beyond the rear side of the front slider plate, the elongated wicket aperture further comprising a lengthwise wicket receiving portion sized to loosely receive the distal ends of the wicket arms therethrough, and an adjacent contiguous lengthwise wicket retaining portion sized to snugly receive the wicket arms and minimize movement thereof within the elongated front wicket aperture;

wherein the front wicket aperture is configured to allow unimpeded lateral movement of a fully inserted cartridge of wicketed bags between the wicket receiving portion and the wicket retaining portion of the wicket slot.

2. The apparatus of claim 1, further comprising:

a rear slider plate having a rear wicket aperture, wherein the rear slider plate is positioned behind the front slider plate and the front and rear wicket apertures are aligned.

3. The apparatus of claim 1, further comprising:

a bag retaining means having an upper edge and a lower edge, wherein the bag retaining means is affixed at its upper edge to the front slider plate above the front wicket aperture, and the lower edge extends below the front wicket aperture.

4. The apparatus of claim 1, further comprising a wicket retaining arm on the front of the front slider plate for retaining the wicket in position in the wicket aperture.

5. The apparatus of claim 4, wherein the wicket retaining arm is parallel to the front wicket aperture, and is affixed to the front slider plate near the wicket retaining portion of the front wicket aperture.

6. A method for removably installing a cartridge of wicketed bags on a bag loading apparatus, wherein the cartridge of wicketed bags comprises a wicket having a cross member, a pair of wicket arms each having a first end affixed to the crossmember and a second distal end, and a plurality of bags suspended on the wicket arms proximate the wicket crossmember, and wherein the bag loading apparatus comprises a front slider plate having a front side, a rear side, and a single elongated wicket slot therethrough comprising a lengthwise wicket receiving portion and a contiguous adjacent lengthwise wicket retaining portion formed therein, the method comprising the steps of:

inserting the distal ends of the wicket arms into the wicket receiving portion of the wicket slot so that the crossmember presses the bags against the front side of the slider plate and the distal ends of the wicket arms extend substantially horizontally beyond the rear side of the slider plate;

Sliding the cartridge sideways along the wicket slot to the wicket retaining portion, while continuing to press the crossmember and bags against the front slider plate.

7. A method for removing a bag wicket from a bag loading apparatus, wherein the wicket comprises a crossmember and a pair of wicket arms each having a first end affixed to the crossmember and a second distal end, and wherein the bag loading apparatus comprises a front slider plate having a front side, a rear side, and a single elongated wicket slot therethrough comprising a lengthwise wicket receiving portion and a contiguous adjacent lengthwise wicket retaining portion formed therein, and wherein the wicket is removably held in the wicket retaining portion of the wicket slot with the crossmember positioned on the front side of the slider plate and the distal ends of the wicket arms extending substantially horizontally beyond the rear side of the slider plate, the method comprising the steps of:

Sliding the bag wicket sideways, from the wicket retaining portion to the wicket receiving portion of the wicket slot; and, Pulling the bag wicket away from the front slider plate.

8. An apparatus for loading, supporting, and replacing a cartridge of wicketed bags on a packing machine, wherein the cartridge of wicketed bags comprises a wicket having a crossmember, a pair of spaced apart wicket arms each having a first end affixed to an end of the crossmember and a second distal end, and one or more bags suspended from the wicket arms, the apparatus comprising:

a front slider plate adapted to be affixed to the packing machine, the front slider plate having a front side, a rear side, and an elongated front wicket slot, wherein the slider plate is adapted receive the cartridge of wicketed bags such that the wicket crossmember and bags remain on the front side of the slider plate and the distal ends of the wicket arms pass through the wicket slot and extend beyond the rear side of the slider plate;

a first lengthwise portion of the front wicket slot comprising a wicket receiving portion sized to loosely receive the pair of wicket arms, the wicket receiving portion defining a cartridge loading and replacing position; and a second lengthwise portion of the front wicket slot adjacent to and contiguous with the wicket receiving portion, comprising a wicket retaining portion sized to snugly receive the wicket arms and minimize movement thereof within the wicket slot, the wicket retaining portion defining a cartridge supporting position;

wherein the cartridge loading and replacing position is adjacent to the cartridge supporting position, and the front wicket slot permits unimpeded lateral movement of a fully inserted cartridge of wicketed bags between the cartridge loading and replacing position and the cartridge supporting position.

9. The apparatus of claim 8, further comprising:

a rear slider plate having a rear wicket slot for receiving the wicket arms, wherein the rear slider plate is positioned behind the front slider plate, the rear wicket slot comprises a single elongated slot, and the front and rear wicket slots are aligned.

10. The apparatus of claim 8, further comprising:

a downwardly extending bag retaining means having an upper edge and a lower edge, wherein the bag retaining means is affixed at its upper edge to the front of the front slider plate above the front wicket slot, and the unattached lower edge extends below the front wicket slot.

11. The apparatus of claim 8, further comprising a wicket retaining arm on the front side of the front slider plate for retaining the wickets in position in the wicket retaining portion of the wicket slot.

12. The apparatus of claim 11, wherein the wicket retaining arm is parallel to the wicket slot, and is affixed to the front slider plate near the wicket retaining portion of the wicket slot.

* * * * *